US006971926B1

(12) United States Patent
Walton

(10) Patent No.: US 6,971,926 B1
(45) Date of Patent: Dec. 6, 2005

(54) FAST CHANGE TRANSFORMER CONNECTOR AND ADAPTOR

(76) Inventor: Christopher E. Walton, 1110 NW. 91 St., Miami, FL (US) 33150

( * ) Notice: Subject to any disclaimer, the term of this patent is extended or adjusted under 35 U.S.C. 154(b) by 0 days.

(21) Appl. No.: 10/987,490

(22) Filed: Nov. 12, 2004

Related U.S. Application Data

(63) Continuation-in-part of application No. 10/305,859, filed on Nov. 27, 2002, now Pat. No. 6,837,754.

(51) Int. Cl.[7] ..... H01R 11/09
(52) U.S. Cl. ..... 439/798; 439/801; 439/811
(58) Field of Search ..... 439/796–799, 439/790, 801, 805, 810, 811, 957

(56) References Cited

U.S. PATENT DOCUMENTS 3,876,279 A * 4/1975 Underwood ..... 439/797
6,612,879 B1 * 9/2003 Zahnen ..... 439/798
6,663,443 B1 * 12/2003 Smith et al. ..... 439/811

* cited by examiner

*Primary Examiner*—Hae Moon Hyeon
(74) *Attorney, Agent, or Firm*—Yi Li

(57) ABSTRACT

A fast change electric transformer connector is disclosed, which includes a cable connector having a cable attachment section, a connector extension connected to the cable attachment section, and a stud slide adaptor connected to a side of the connector extension for slidably attaching the cable connector to a transformer stud; and a stud screw adaptor complimentary to a transformer stud. The cable attachment section includes a cable receiving body having multiple receiving slots for receiving cables; and multiple removable sliding cable fastening blocks disposed within the receiving slots for fastening the cables. Each sliding cable fastening block can be slid in or out from the receiving slot for conveniently installing a large cable. Also disclosed are a transformer connector and a transformer adaptor, which have an adaptor extension for connecting between the transformer stud and the cable connection portion of the connector/adaptor, for use when shorted cables are cut.

26 Claims, 9 Drawing Sheets

FAST CHANGE TRANSFORMER CONNECTOR AND ADAPTOR

REFERENCE TO RELATED APPLICATION

This application is a continuation-in-part application of patent application Ser. No. 10/305,859, filed Nov. 27, 2002, now U.S. Pat. No. 6,837,754 which is hereby incorporated by reference in its entirety.

FIELD OF THE INVENTION

The present invention relates to the field of electric power distribution, and, more specifically, to fast change transformer connectors, which enable changing a transformer without disconnecting electric cables from the connectors.

BACKGROUND OF THE INVENTION

Transformers are key components presently in electric power distribution networks. Generally, electric power is distributed from electrical substations at high voltage typically in excess of 6,000 volts to minimize losses. Transformers are required to reduce the voltage down to lower levels, such as 120 volts, for local distribution to commercial and residential customers.

A transformer commonly used for this purpose is housed in a steel cabinet on a concrete platform or pad at ground level. The transformer itself includes primary and secondary coils housed in an oil-filled transformer well, the oil being provided to keep the coils cool. Typically, studs, to which cables, or in a general term, conductors, carrying high voltage power to the primary coils, and to which cables carrying reduced voltage from the secondary coils can be attached, protrude laterally outward from the transformer through the wall of the transformer well.

The studs are insulated from the wall of the transformer well by an insulating bushing or seal, which must be impermeable to the oil filling the transformer well. There are usually two to six studs for attaching incoming cables to the primary side, and three to four studs for attaching outgoing cables to the secondary side. Typically, there are a minimum of three studs required on the secondary side, one for each of two phases and one for a return or ground cable.

Transformers of this type may be used to deliver electric power to a relatively small number of end consumers. To supply each such consumer, one cable from each of the studs on the secondary side of the transformer is required. Typically, then, a number of cables are connected to each of the studs, one for each of the consumers being served.

Transformer connectors are used to attach the individual cables to the studs. One of the most commonly used transformer connectors is spade connector. A spade connector has a female connection end which is screwed onto a transformer stud through the screw threads on both of the stud and the spade connector. Each cable end encapsulated in a cable end lug is screwed onto the spade connector by a set of screw through one of the cable adapting ports of the spade connector.

With these traditional spade connectors, when a transformer needs to be replaced because it is no longer functioning, an electrician has to disconnect each of the cables, usually from three to thirty cables, before the spade connector can be taken off from the stud by rotating the spade connector around the stud. Moreover, each disconnected cable has to be grounded immediately for safety reasons. After the old transformer is replaced by a new transformer and the spade connectors are connected onto the studs of the new transformer, each one of the disconnected cables then has to be bolted onto the spade connector again.

Furthermore, the cable end lug closest to the stud on the spade connector are relatively difficult to access. To reach a set of bolt and nut for a cable end lug axially closest to the stud along the cable, the electrician must reach in toward the stud over a number of cables. Even worse, the inner set bolts may not be readily visible, forcing the electrician to work blindly. Moreover, as the three or four studs are often arranged one above the other on the wall of the transformer well, the electrician may often be required to reach between two layers of cables to adjust the blot of a cable attached close to a stud. Still further, bolts might have become corroded causing extreme difficulty in removing the cables.

It is apparent that this is a lengthy and labour intensive process. It usually takes from about two and half hours to about three hours to change a transformer that carries thirty electrical cables, mainly because the time required for disconnecting and connecting the cables to the spades.

Attempts have been made to address these problems. One such attempt is multi-tap stud connectors. A multi-tap stud connector has a block structure with a transformer stud port and a plurality of cable ports. A multi-tap stud connector is connected to a transformer stud through the transformer stud port and fastened by screws along the side of the transformer stud port. To disconnect the multi-tap stud connector, one loosens the screws, typically two, and detaches the multi-tap stud connector from the transformer stud without disconnecting electrical cables. The multi-tap stud connectors are currently used as an after market product, to replace spade connectors during replacement of a non-functioning transformer. Multi-tap stud connectors have certain disadvantages. As described above, a multi-tap stud connector is connected to a transformer stud through the transformer stud port and fastened by two screws along the side of the transformer stud port. Such a connection is not as secure as the connection of a traditional spade connector, which is directly bolted on to the transformer stud. Furthermore, multi-tap connectors are made of aluminum, which is different from the transformer stud material of brass. For a long term use, the connection between aluminum and brass tends to become loose, causing poor connection between the transformer and the connector. For most transformers, particularly the large transformers, spade connectors are still the most commonly used in the field.

Therefore, it is apparent that there exists a continuing need to provide improved transformer connectors that enable the rapid change of a transformer and reduce power supply downtime. The present invention represents a novel approach toward a solution of the problems associated with the lengthy and labor intensive process involved in changing transformers.

SUMMARY OF THE INVENTION

In one embodiment, the present invention provides transformer connectors which enable fast replacement of an electric transformer without disconnecting electrical cables. The transformer connector comprises a cable connector having a cable attachment body with a plurality of cable attachment ports, a connector extension with the first end connected to the cable attachment body, and a stud slide adaptor connected to a side of the connector extension near the second end; and a stud screw adaptor having a threaded opening complimentary to a transformer stud, for connecting the transformer stud and the stud slide adaptor of the cable connector.

Moreover, the transformer connector can further comprise an adaptor extension. The adaptor extension has an extension body having a first end portion and an opposing second end portion, a front side and a rear side. The extension body has an unthreaded opening at the first end portion for adapting to the transformer stud and engaging with the stud screw adaptor from the rear side; and an extension connection means at the second end portion for connecting the stud slide adaptor of the cable connector from the front side of the extension body.

In a further embodiment, the transformer connector of the present invention has a cable attachment section which comprises cable receiving body having a plurality of receiving slots, each thereof for receiving a cable; and a plurality of removable sliding cable fastening blocks disposed within the plurality of receiving slots. Each of the sliding cable fastening blocks can be slid in and out from the receiving slot for receiving and fastening a cable.

In another embodiment, the present invention provides a transformer adaptor, which can, be used to connect an electrical cable connector to a transformer stud. The transformer adaptor comprises an inter-connector comprising a connecting shaft having screw threads at one end; and a stud slide adaptor connected to a side of the connecting shaft at the opposing end; and a stud screw adaptor having a threaded opening complimentary to a transformer stud, for connecting the transformer stud and the stud slide adaptor of the inter-connector. The transformer adaptor of the present invention can be used with existing transformer connectors, such as spade connectors, for conveniently detach the transformer connectors without disconnecting the electrical cables. Furthermore, the transformer adaptor can also comprise an adaptor extension, as described above, for connecting the inter-connector to the transformer.

BRIEF DESCRIPTION OF THE DRAWINGS

The above and other features and advantages of the present invention will be more clearly understood from the following detailed description taken in conjunction with the accompanying drawings, in which.

DETAILED DESCRIPTION OF THE INVENTION

Figure 1:
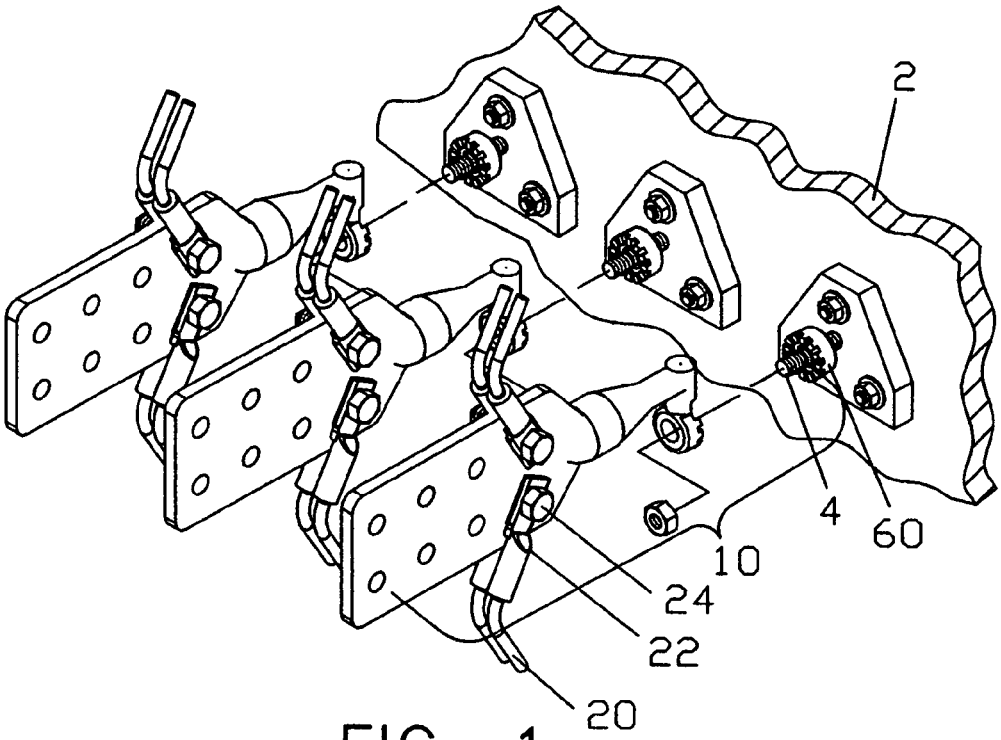
FIG. 1 is a perspective view of three transformer connectors of the present invention, showing the stud slide adaptor of the transformer connectors to be attached to each of three studs of the transformer with electrical cables attached to each of the transformer connectors.

Referring now to the drawings. As shown in FIG. 1, three transformer connectors 10 of the present invention are to be attached to a transformer 2. A plurality of electrical cables 20 are attached to transformer connector 10, wherein each cable 20 is connected to transformer connector 10 through a cable end lug 22, and secured onto transformer connector 10 by a set of bolt and nut 24. Each cable 20 provides electricity from transformer 2 to a user.

Figure 2:
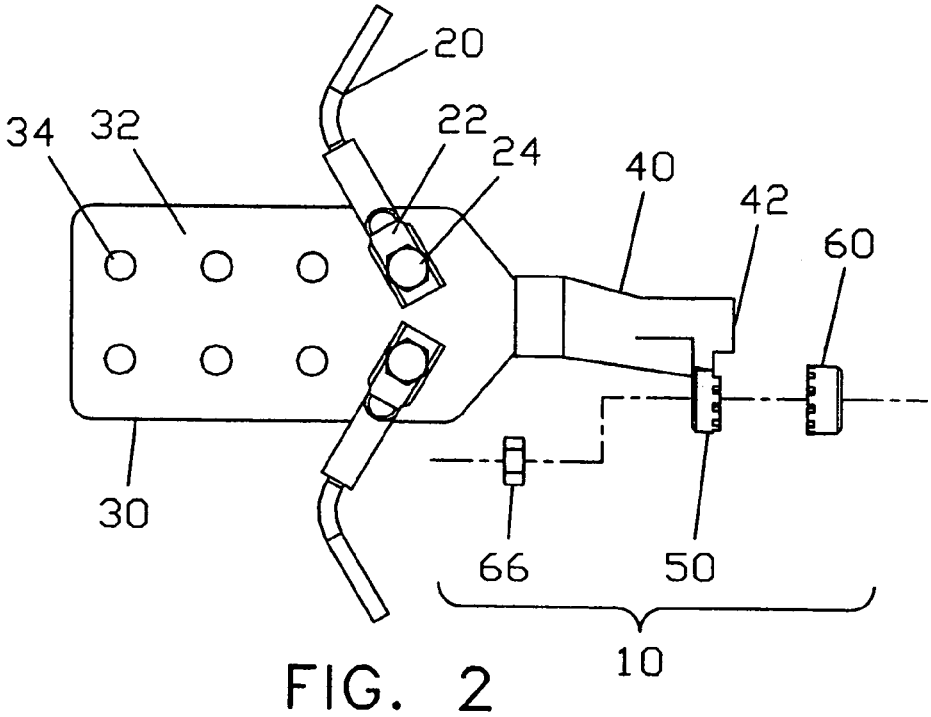
FIG. 2 is a side view of a transformer connector of one embodiment of the present invention.
Figure 3A:
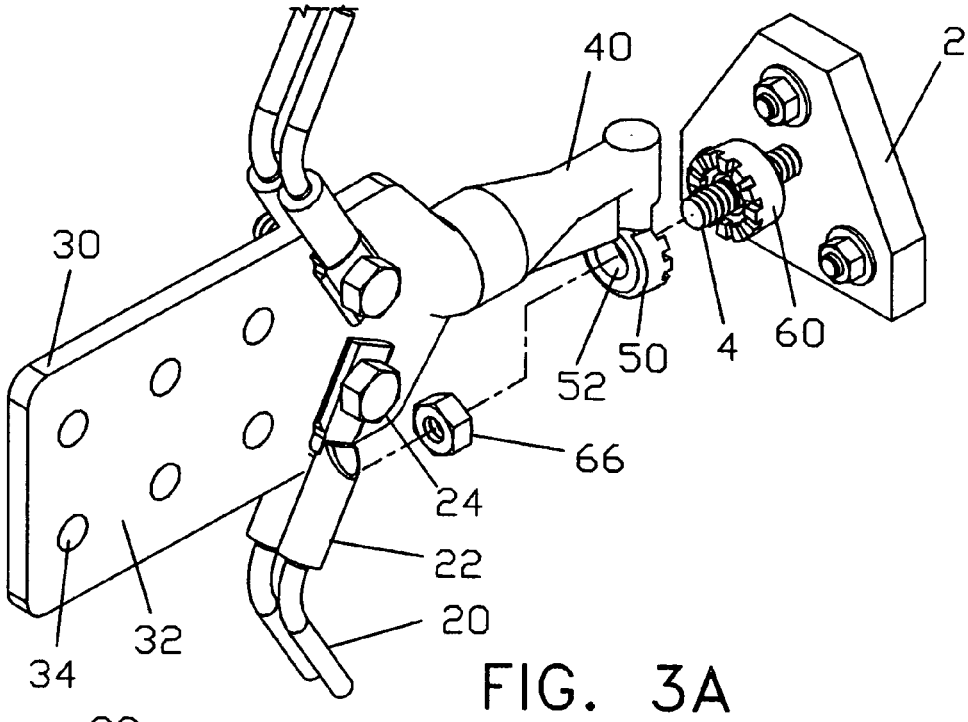
FIGS. 3A and 3B are perspective views of the transformer connector shown in FIG. 2, showing the stud slide adaptor of the transformer connector to be attached to a stud of a transformer.
Figure 3B:
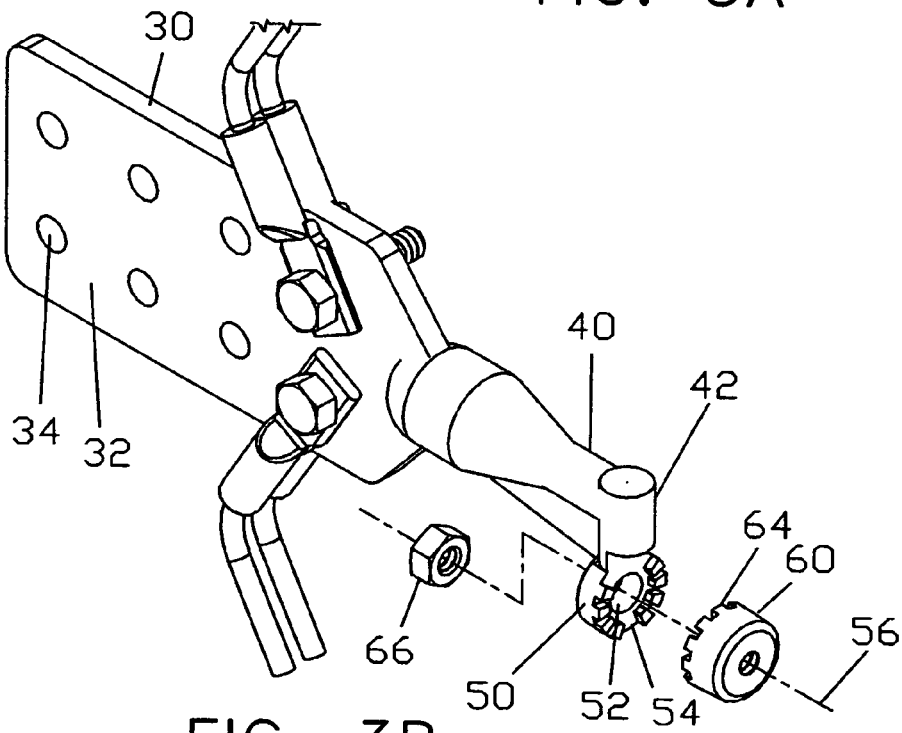
Figure 4A:
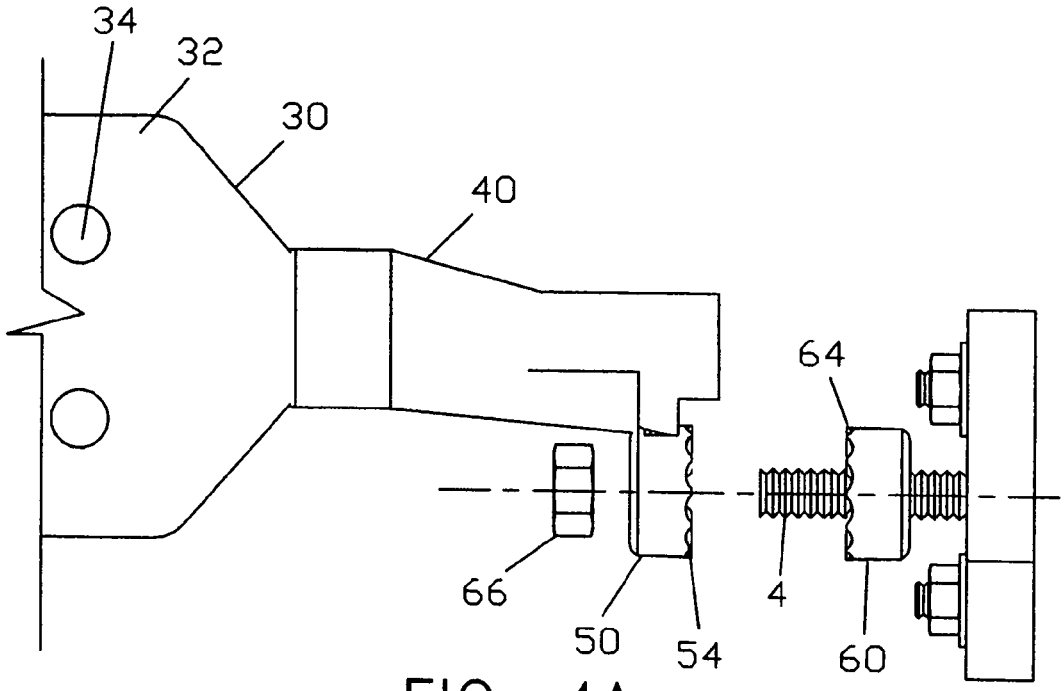
FIGS. 4A and 4B are side views of the transformer connectors of one embodiment of the present invention, showing two different geometry shapes at contact surfaces of the stud slide adaptor and stud screw adaptor.
Figure 4B:
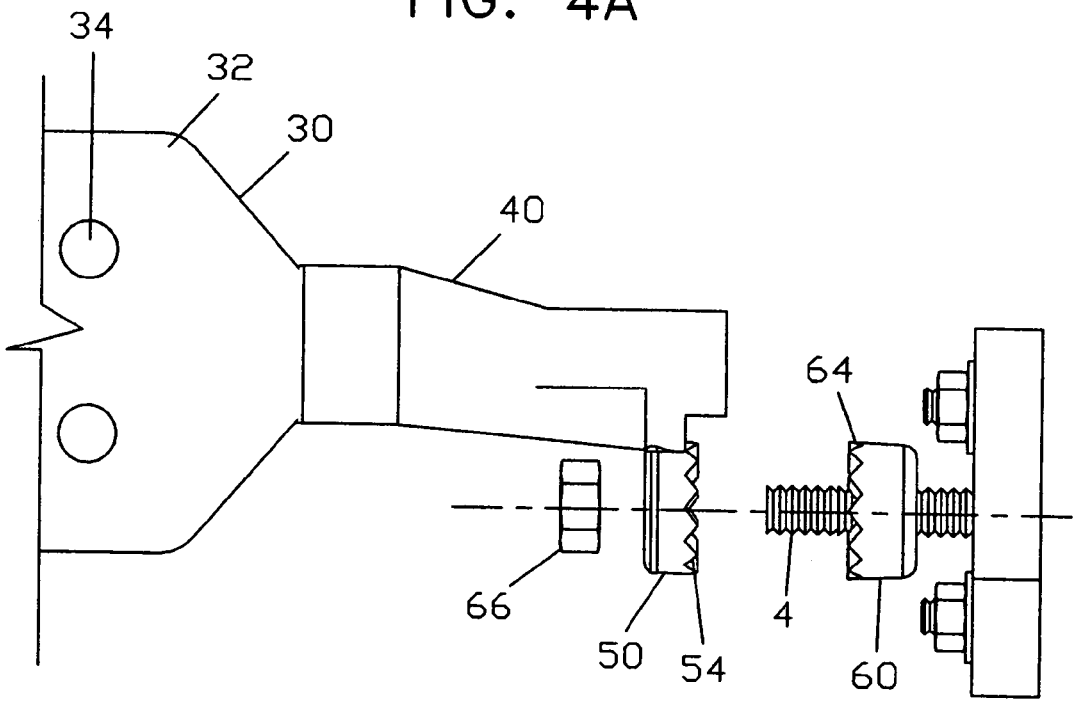
Figure 5A:
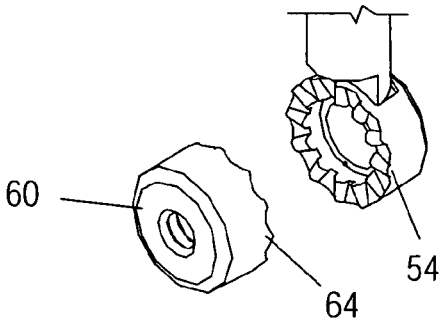
FIGS. 5A and 5B are perspective views of the contact surfaces of the stud slide adaptor and stud screw adaptor of transformer connectors shown in FIGS. 4A and 4B, respectively.
Figure 5B:
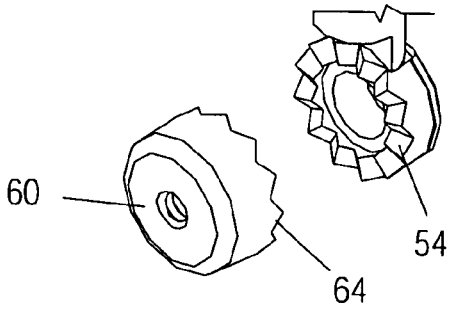

As shown in FIGS. 2, 3A and 3B, transformer connector 10 comprises an electrical cable connector 30, and a stud screw adaptor 60 having a threaded opening 62 which has internal threads complimentary to a transformer stud 4, for connecting transformer stud 4 and cable connector 30. The cable connector 30 includes a cable attachment body 32 having a plurality of cable attachment ports 34; a connector extension 40 having a first end 41 connected to cable attachment body 32; and a stud slide adaptor 50 connected to a side of connector extension 40 near second end 42. Stud slide adaptor 50 has an opening 52, wherein center axis 56 of opening 52 is substantially parallel to the longitudinal axis of connector extension 40. The transformer connector 10 further includes a bolt nut 66 for fastening stud slide adaptor 50 onto transformer stud 4.

As shown in FIGS. 3A and 3B, stud slide adaptor 50 has an unthreaded circular opening 52 for adapting to transformer stud 4. The diameter of circular opening 52 is greater than the diameter of transformer stud 4, so that stud slide adaptor 50 can be conveniently adapted onto transformer stud 4. The stud slide adaptor 50 has a contact surface 54, which is in perpendicular to central axis 56 of circular opening 52. The contact surface 54 interfaces with a contact surface 64 of stud screw adaptor 60. As shown, contact surfaces 54 and 64 can have a complimentary geometry shape for providing maximum surface contact between the two surfaces. FIGS. 3A and 3B show a rectangular teeth shape at contact surfaces 54 and 64. However, various shapes can be utilized, such as sine wave shape and triangular shape shown in FIGS. 4A, 4B, 5A and 5B, and a flat surface. Preferably, contact surfaces 54 and 64 have a large contact area, and a smooth contact in order to conduct electricity effectively, and to avoid poor connections.

Furthermore, a proper complimentary geometry shape, such as rectangular teeth shape, sine wave shape and triangular shape also provide an inter-locking mechanism between stud slide adaptor 50 and stud screw adaptor 60. The inter-locking interface facilities an electrician's assembling process, and ensures proper contact between stud slide adaptor 50 and stud screw adaptor 60.

The external shape and size of stud slide adaptor 50 and stud screw adaptor 60 can be the same, as shown in the FIGS. 2, 3A and 3B. However, they can also be different. For example, stud screw adaptor 60 can be a larger block with a circular central indentation complimentary to the external shape and size of stud slide adaptor 50. In this type of structure, stud slide adaptor 50 can be inserted into the indentation to ensure a proper connection. The bolt nut 66 is a regular commercially available bolt nut as long as it is compatible with transformer stud 4.

Preferably, cable connector 30 has an integrated structure having cable attachment body 32, connector extension 40, and stud slide adaptor 50 moulded together. An integrated structure provides structural strength, and reduces connection interfaces, which is desired for conducting electricity effectively. The cable connector 30 can be made of copper, iron, aluminum, and other suitable electrical conducting materials.

Figure 6:
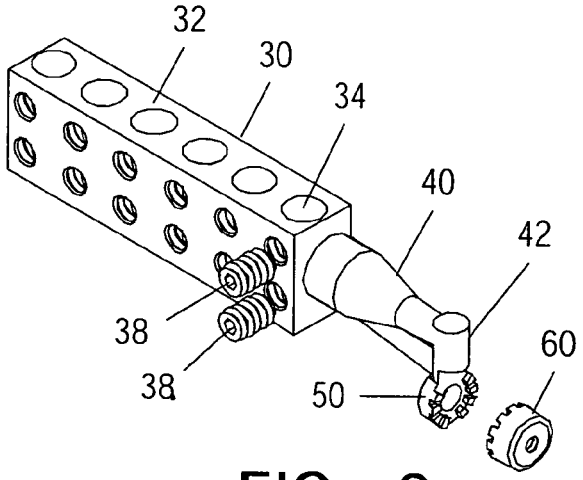
FIG. 6 is a perspective view of the transformer connector having a multi-tap block as the cable attachment body of one embodiment of the present invention.
Figure 7:
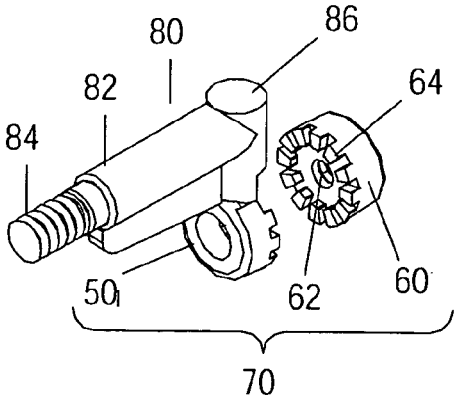
FIG. 7 is a perspective view of the transformer adaptor of one embodiment of the present invention.

As shown in FIGS. 2, 3A and 3B, cable attachment body 32 has a structure of traditional spade connector. However, other suitable structures, such as a structure of multiple tap stud connector, can also be used, as illustrated in FIG. 6. As shown in FIG. 6, cable attachment body 32 merely connects electrical cables 20 through cable attachment ports 34, which are secured by a pair of screws 38. It is understood that the connection with transformer is provided by stud slide adaptor 50 and stud screw adaptor 60, regardless of the shape and mechanism of cable attachment body 32. Several existing transformer connectors can be modified by incorporating connector extension 40 and stud slide adaptor 50 of the present invention. Their individual cable connection mechanism can be maintained.

The connector extension 40 as shown is a straight circular shaft with an enforcement rim. However, other suitable shapes and structures, such as a square shape at the cross section of the shaft, and with a certain angle along the shaft, can also be utilized for the purpose of the present invention. The length and diameter of the shaft can be determined depending on the structure of cable attachment body 32, the number of cables, and the weight that the transformer connector 30 carries.

The transformer connector of the present invention provides a convenient connection mechanism between the transformer and the electrical cables. To connect transformer connector 10 to transformer 2, an electrician first screws stud screw adaptor 60 onto transformer stud 4, then slides stud slide adaptor 50 onto transformer stud 4 and engages stud screw adaptor 60, and last screws on bolt nut 66 to tighten the connection between stud slide adaptor 50 and stud screw adaptor 60. To disconnect transformer connector 10 from transformer 2, the electrician simply reverses the process described above. Since no rotation is required to unscrew cable connector 30 around transformer stud 4, once electrical cables 20 are connected to cable connector 30, they do not need to be disconnected in the process of changing transformer. Moreover, when cable connector 30 is disconnected from transformer stud 4 during the change of transformer, only one time grounding of cable connector 30, instead of grounding of disconnected each cable, is required. This convenient connection mechanism, provided by the engagement of stud slide adaptor 50 and stud screw adaptor 60 with transformer stud 4, offers substantial reduction of time and labour involved in replacing a transformer. The estimated time for changing a transformer connected with thirty cables can be reduced from an original two and half to three hours down to thirty minutes to about one hour. With such a substantial reduction on the electrical power supply downtime, the impacts on financial recovery of consumers, particularly manufacturers, cost reduction of power suppliers, and consumer living conditions are enormous. Therefore, the transformer connector of the present invention has important economical, financial and social significance.

In the second embodiment, the present invention is related to a transformer adaptor. As shown in FIG. 6, transformer adaptor 70 comprises an inter-connector 80, and a stud screw adaptor 60 for connecting inter-connector 80 and transformer stud 4. The inter-connector 80 includes a connecting shaft 82 which has embedded male screw threads at one end 84, also called cable end; and a stud slide adaptor 50 connected to a side of said connecting shaft at the opposing end 86, also called transformer end. The transformer adaptor 70 further includes a bolt nut 66 which is described previously.

The structures of stud slide adaptor 50 and stud screw adaptor 60 of transformer adaptor 70, and the mechanism of connection to transformer 2 are the same as those of transformer connector 10 described in detail in the first embodiment.

Figure 8:
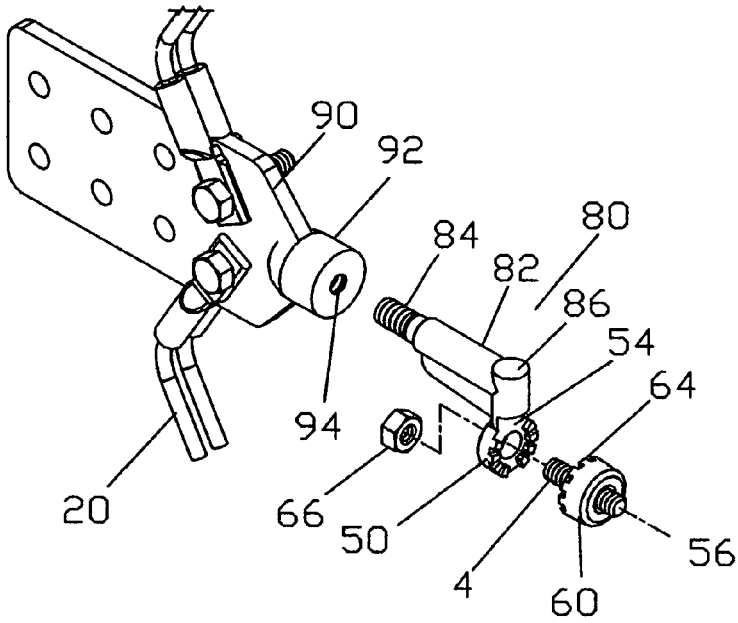
FIG. 8 is a perspective view of the transformer adaptor of one embodiment of the present invention, which is to be connected to a traditional spade connector and a transformer stud.
Figure 9:
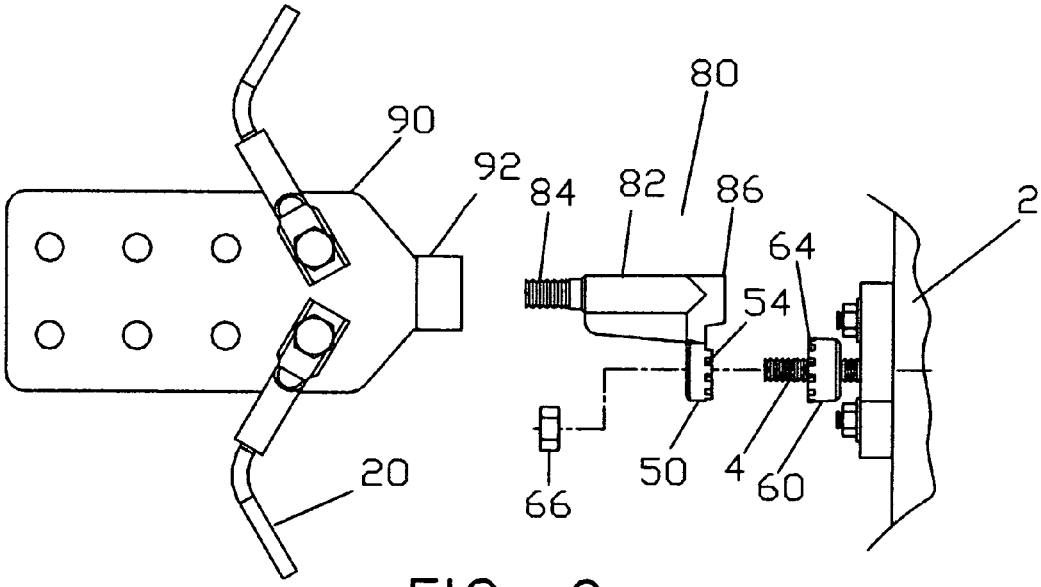
FIG. 9 is a side view of the transformer adaptor shown in FIG. 8.

As illustrated in FIGS. 8 and 9, transformer adaptor 70 is used to connect a cable connector which has embedded female screw threads within the body of the cable connector, which is commonly used for connecting to transformer stud 4. FIG. 8 shows the female adapting end 92 of a traditional spade connector 90. Traditionally, to connect spade connector 90 onto transformer 2, an electrician turns spade connector 90 around transformer stud 4, and then attach cables 20 to spade connector 90. To disconnect spade connector 90 from transformer 2, the electrician has to disconnect each individual cable 20 before spade connector 90 can be turned around transformer stud 4 in the opposite direction.

With transformer adaptor 70 of the present invention, one can continue to use existing spade or other connectors without disconnecting electrical cables from these connectors. As shown in FIGS. 8 and 9, to connect a conventional spade connector 90 to transformer 2, the electrician first adapts inter-connector 80 to spade connector 90 by screwing cable end 84 of inter-connector 80 into female adapting end 92 of spade connector 90, and screws stud screw adaptor 60 onto transformer stud 4, then slides stud slide adaptor 50 of inter-connector 80 onto transformer stud 4, and last screws bolt nut 66 to tighten the connection between stud slide adaptor 50 and stud screw adaptor 60. Using inter-connector 80, electrical cables 20 can be attached to spade connector 90 before or after spade connector 90 is connected to transformer 2.

To disconnect spade connector 90 from transformer 2 for replacing transformer, the electrician can simply disconnect transformer adaptor 70 from transformer stud 4 by taking off bolt nut 66, and sliding stud slide adaptor 50 out from transformer stud 4. Cables 20 do not need to be disconnected from spade connector 90. As discussed previously, the convenient connection mechanism provided by the present invention enables a fast change of a transformer by eliminating the steps of disconnecting individual cables.

The screw threads at cable end 84 of inter-connector 80 should be complimentary to the female screw threads of a specific connector of which the transformer adaptor 70 is used for. The material and structural features of transformer adaptor 70 are similar to those described previously for transformer connector 10.

In the field work of repairing faulted transformer and cables, when the cables are shorted, it is more time saving to cut the end of the shorted cables, instead of changing the cables. In this situation, the cut cables can be a few inches shorter to allow the transformer connector to be attached to the transformer stud in the manner described above. In a further embodiment, the present invention provides an adaptor extension for meeting such a need.

Figure 10:
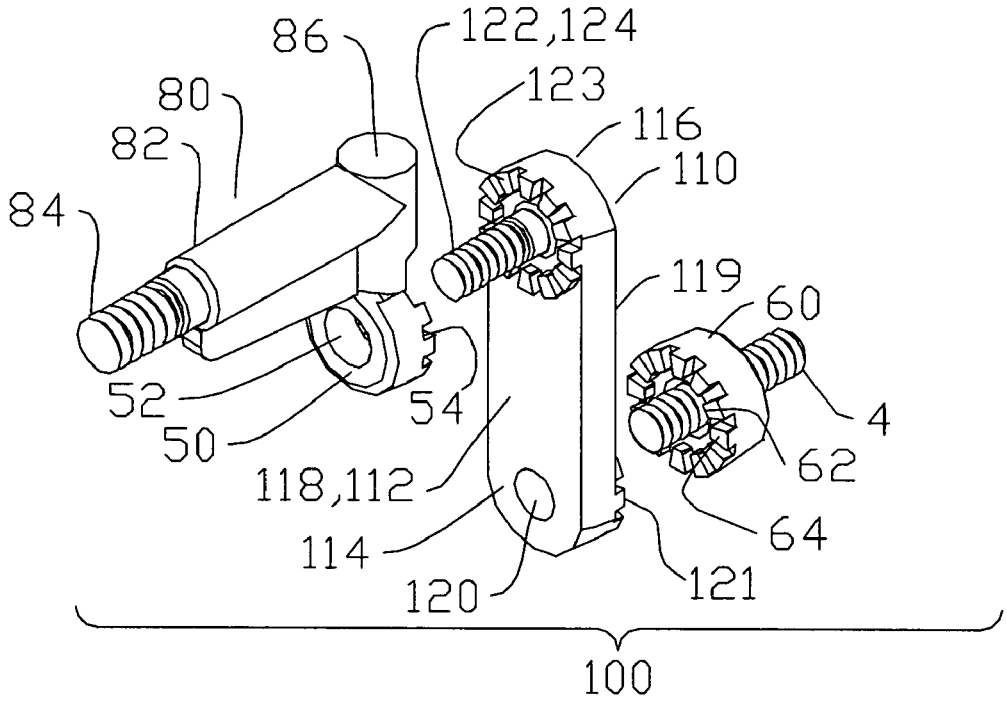
FIG. 10 is a perspective view of a transformer adaptor of a further embodiment of the present invention, wherein the adaptor extension has a threaded shaft for connecting the inter-connector.
Figure 12:
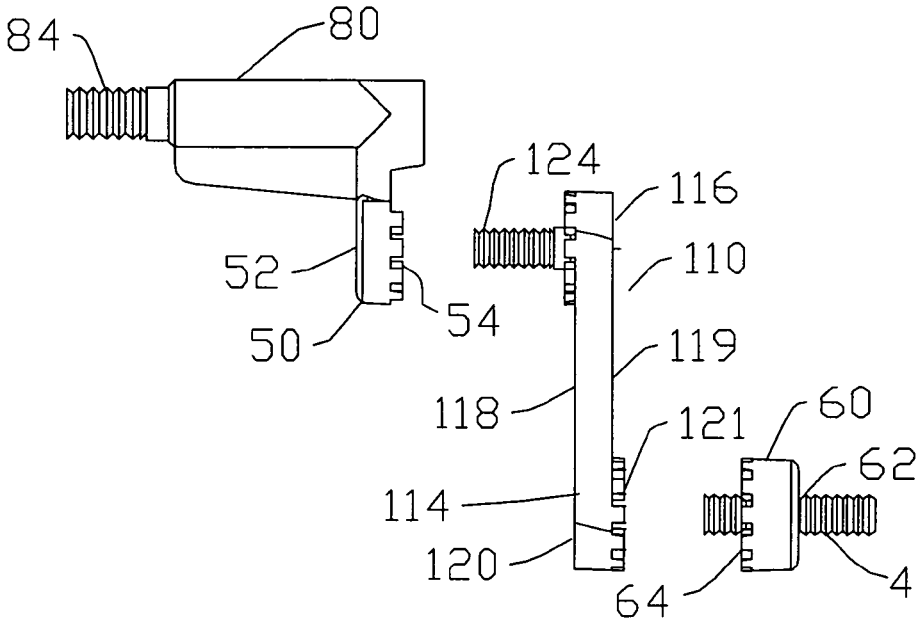
FIG. 12 is a side view of the transformer adaptor of FIG. 10.

Referring now to FIGS. 10 and 12, transformer adaptor 100 includes inter-connector 80, stud screw adaptor 60 and an adaptor extension 110. Adaptor extension 110 comprises an extension body 112 that has a first end portion 114 and an opposing second end portion 116, a front side 118 and a rear side 119. Extension body 112 has an unthreaded opening 120 at first end portion 114, for adapting to transformer stud 4 and engaging with stud screw adaptor 60 from the rear side 119; and an extension connection means 122 at second end portion 116 for connecting stud slide adaptor 50 of inter-connector 80. It is noted that Inter-connector 80 has the same structure as described previously.

In the embodiment shown in FIGS. 10 and 12, the extension connection means 122 is a threaded shaft 124 protruding from front side 118 at second end portion 116. Threaded shaft 124 is complementary in size to, and for engaging with, unthreaded opening 52 of inter-connector 80, such that adaptor extension 110 can be connected to inter-connector 80 by inserting threaded shaft 124 through unthreaded opening 52 and fastened by a bolt nut (not shown).

As described previously, stud slide adaptor 50 has a contact surface 54 around unthreaded opening 52, in perpendicular to the center axis of unthreaded opening 52; and stud screw adaptor 60 also has a contact surface 64 around threaded opening 62, in perpendicular to the center axis of threaded opening 62. Adaptor extension 110 has a contact surface 121 around unthreaded opening 120 at rear side 119, in perpendicular to the center axis of unthreaded opening 120 for interlockingly engaging with contact surface 64 of stud screw adaptor 60. Adaptor extension 110 further has a contact surface 123 around threaded shaft 124 at front side 118 for interlockingly engaging with contact surface 54 of stud slide adaptor 50.

Figure 11:
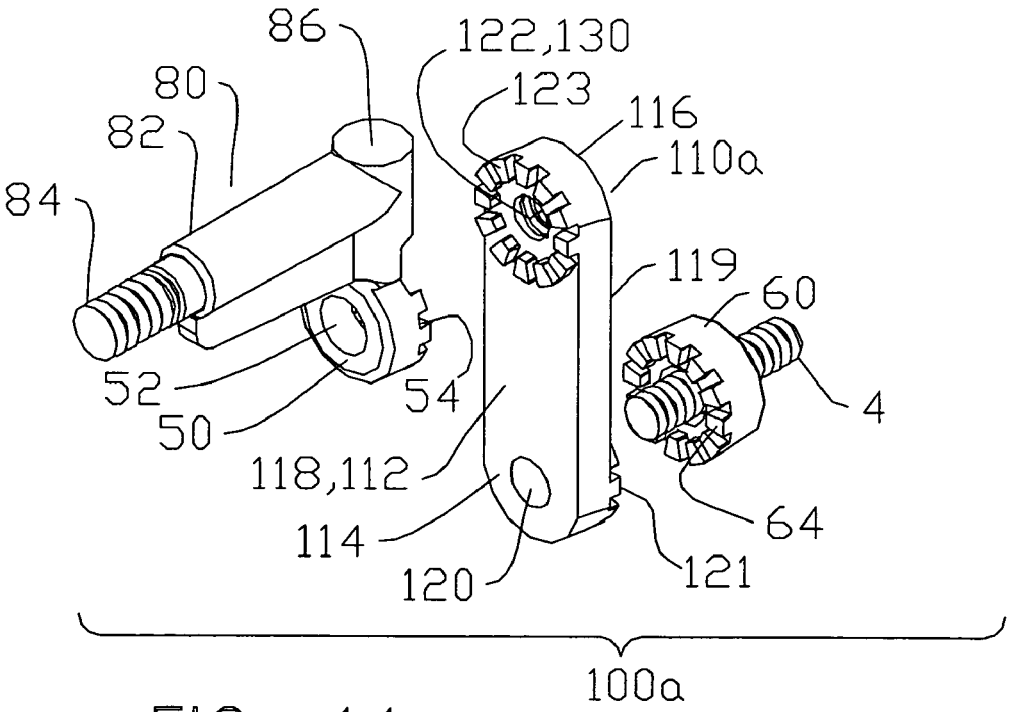
FIG. 11 is a perspective view of a transformer adaptor of a further embodiment of the present invention, wherein the adaptor extension has a threaded opening for connecting the inter-connector by bolt and nuts.

FIG. 11 shows a variation of adaptor extension 110 illustrated in FIG. 10. In adaptor extension 110*a* of transformer adaptor 100*a*, extension connection means 122 is a threaded opening 130 at second end portion 116, which is substantially equivalent in size to unthreaded opening 52 of stud slide adaptor 50. With this extension connection means, stud slide adaptor 50 can be connected to adaptor extension 110*a* by placing a threaded bolt (not shown) through threaded opening 130 and unthreaded opening 52, and then fastening the connection by bolt nuts (not shown) at both ends of the threaded bolt. As shown, adaptor extension 110*a* has a contact surface 123 around threaded opening 130 at front side 118 for interlockingly engaging with contact surface 54 of stud slide adaptor 50.

As shown in FIGS. 10 thru 12, extension body 112 has a shape of an elongated panel. The orientation of extension body 112 to the transformer can be vertical as shown in FIGS. 10 thru 12, or any other convenient angles. It should be understood that screw adaptor body 112 can also have other geometric shapes.

The adaptor extension has been described above to interface with a transformer adaptor, however, it should be understood that the adaptor extension can also be used with the transformer connector described in the first embodiment.

In another embodiment, the present invention provides a transformer connector 140 as shown in FIGS. 13–16, which is particularly convenient to use for connecting very large cables to a transformer. Transformer connector 140 includes a cable connector 150, a stud screw adaptor 60, and further includes a bolt nut 66 (not shown). The structures of stud screw adaptor 60 and bolt nut 66 have been described previously. Cable connector 150 has a cable attachment section 160; a connector extension 40 which has a first end 41 connected to cable attachment section 160 and an opposing second end 42; and a stud slide adaptor 50 connected to the side of connector extension 40 adjacent to second end 42. As described previously, stud slide adaptor 50 has an unthreaded opening 52 and a contact surface 54 around unthreaded opening 52 in perpendicular to the center axis of unthreaded opening 52. Unthreaded opening 52 is complementary in size to transformer stud 4, and cable connector 150 can be attached to transformer stud 4 by inserting transformer stud 4 through unthreaded opening 52, interlocking with stud screw adaptor 60, and then fastening by bolt nut 66.

Cable attachment section 160 comprises a cable receiving body 162 that has a plurality of receiving slots 170, each thereof for receiving a cable (not shown); and a plurality of removable sliding cable fastening blocks 190 disposed within receiving slots 170. Each receiving slot 170 has an upper open end 172 and a lower open end 174, two opposing side walls 176, a rear wall 178 and a front opening 180. Each side wall 176 has a locking groove 182 near front opening 180. Each sliding cable fastening block 190 has a front surface 192 and a rear surface 194, two side portions 196, and fastening means 210 for fastening the cable. Each side portion 196 has a protruding rim 198 which is disposed within locking groove 182. The structures and dimension of locking groove 182 and protruding rim 198 are complementary to each other to provide a proper interface between the two components. Each sliding cable fastening block 190 can be moved in and out from receiving slot 170 by sliding along locking grooves 182 through upper open end 172.

As shown in FIGS. 13–16, fastening means 210 comprise one or more threaded apertures 212 through front and rear surfaces 192 and 194 of sliding cable locking block 190, and one or more threaded bolts 214 disposed within threaded apertures 212. A cable positioned within a receiving slot 170 can be fastened by screwing in threaded bolts 214 toward rear wall 178.

In use, the field electrician removes sliding cable fastening block 190 from a receiving slot 170, pushes a cable, in a direction transverse from the direction of the cable, into receiving slot 170 through front opening 180, and then slides the sliding cable fastening block 190 back into receiving slot 170 through locking grooves 182 and fastens the cable by screwing in threaded bolts 214. The transformer connector 140 is particularly convenient to use in the field when one handles very large cables. In this situation, it is very difficult to bend the cables and then insert them into the attachment ports of a spade connector or a block connector. Such an operation has often caused accidental injuries of the field workers. Using transformer connector 140, one does not need to bend the cable, instead, the cable can be pushed into the receiving slot sideways.

Figure 13:
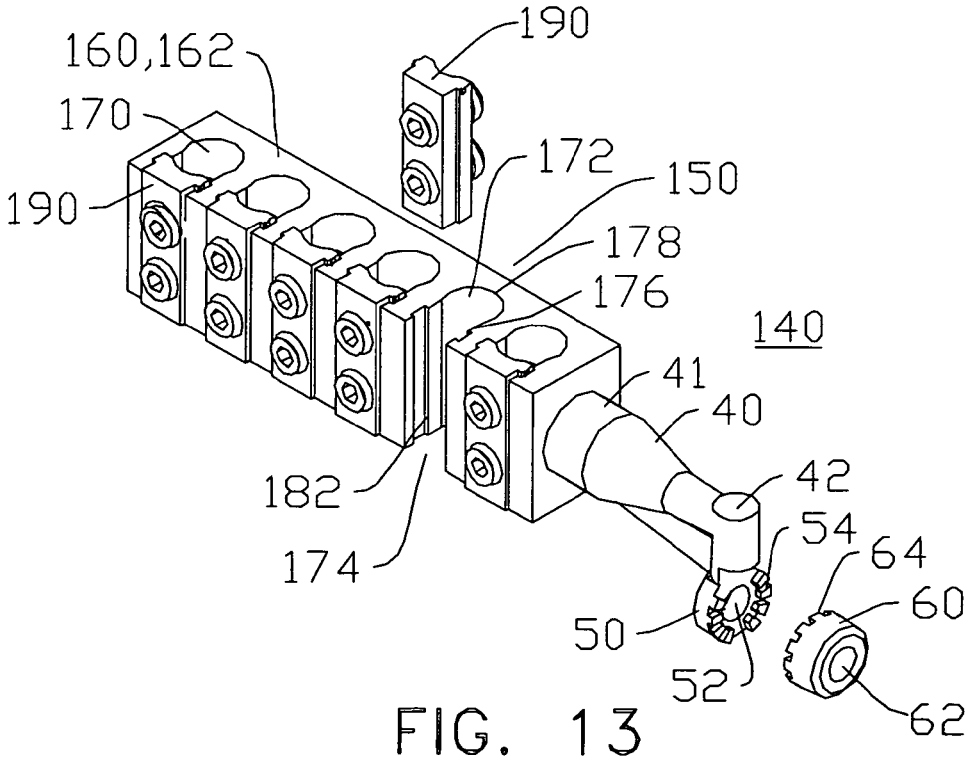
FIG. 13 is a perspective, and partially exploded view of a transformer connector of a yet further embodiment of the present invention, wherein the cable attachment section has a plurality of receiving slots and each has a removable sliding cable fastening block.
Figure 14:
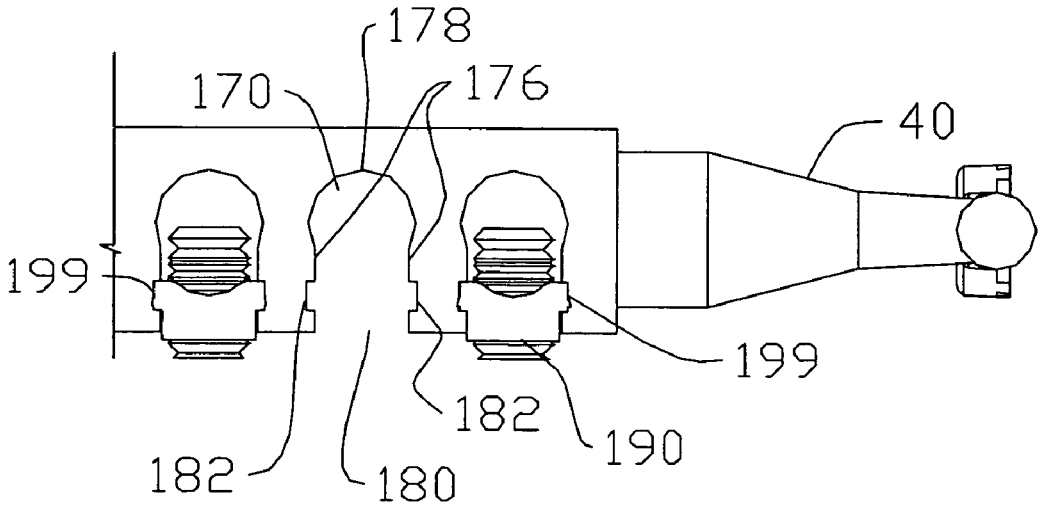
FIG. 14 is a top partial view of the transformer connector of FIG. 13 with one sliding cable fastening block removed from one receiving slot.

Preferably, to provide a stable interface between the cable and receiving slot 170, real wall 178 can have a curvature complementary to the circular external shape of the cable, as shown in FIGS. 13 and 14.

Figure 15:
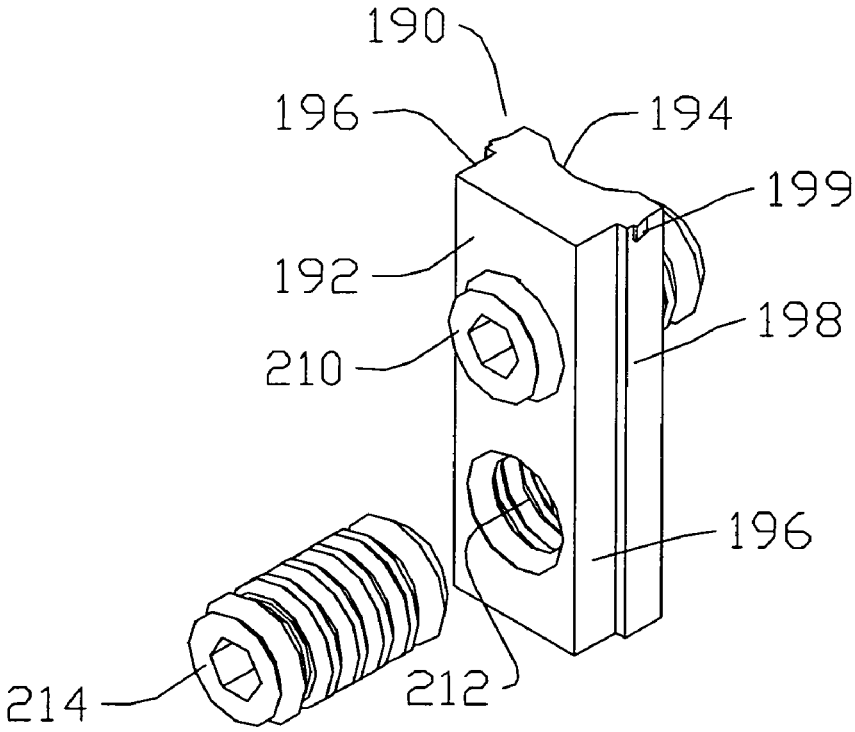
FIG. 15 is a partially exploded perspective view of a sliding cable fastening block.
Figure 16:
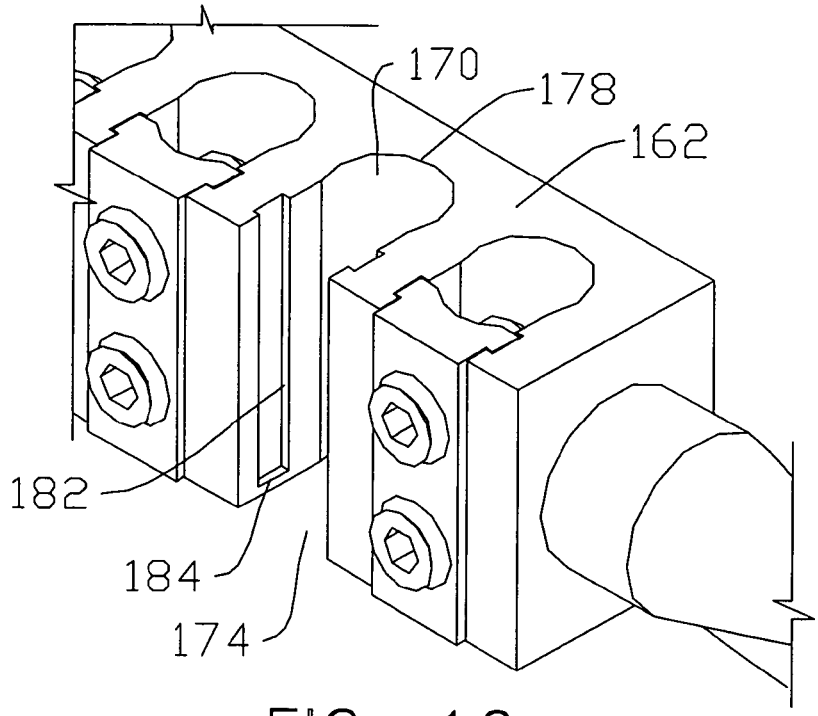
FIG. 16 is an enlarged perspective view of a receiving slot showing the retainer ridge.
Figure 17:
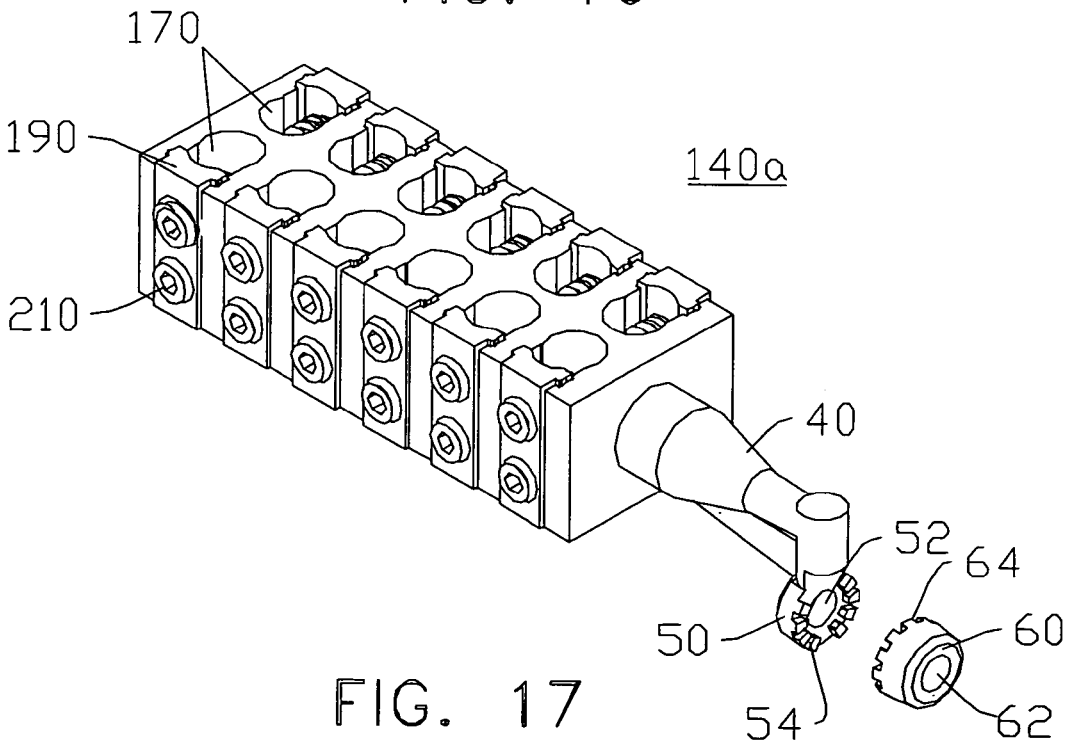
FIG. 17 is a perspective view of a variation of the transformer connector of FIG. 13, wherein the cable attachment section has two rows of receiving slots.

Furthermore, preferably each sliding cable locking block 190 has retainer means for retaining the vertical position of sliding cable locking block 190 inside locking grooves 182 without sliding out from lower open end 174. This assists in releasing the electrician's hands for operation. As shown in FIGS. 13 thru 15, in an exemplary embodiment, the retainer means is a pair of top lips 199, each protruding from protruding rim 198 adjacent to the top of sliding cable locking block 190. Alternatively, the retainer means can also be provided in locking grooves 182. As shown in FIG. 16, in an exemplary embodiment, the retainer means is a retainer ridge 184 disposed at the bottom of each locking groove 182.

As shown in FIG. 13, the plurality of receiving slots 170 are aligned one next to another in a row extending along a longitudinal axis of connection extension 40. FIG. 19 shows a transformer connector 140*a*, which has two rows of receiving slots 170 extending in parallel to a longitudinal axis of connection extension 40. In this structure, a pair of receiving slots 170 have their rear walls 178 against each other.

While the present invention has been described in detail and pictorially shown in the accompanying drawings, these should not be construed as limitations on the scope of the present invention, but rather as an exemplification of preferred embodiments thereof. It will be apparent, however, that various modifications and changes can be made within the spirit and the scope of this invention as described in the above specification and defined in the appended claims and their legal equivalents.

I claim:

1. A transformer connector comprising:

(a) a cable connector comprising a cable attachment section; a connector extension having a first end and an opposing second end, said first end being connected to said cable attachment section; and a stud slide adaptor connected to a side of said connector extension adjacent to said second end, said stud slide adaptor having an unthreaded opening complementary to a transformer stud in size for attaching said cable connector to said transformer stud;

wherein said cable attachment section comprises a cable receiving body having a plurality of receiving slots, each thereof for receiving a cable; and a plurality of removable sliding cable fastening blocks disposed within said plurality of receiving slots; wherein each of said receiving slots has an upper and a lower open ends, two opposing side walls, a rear wall and a front opening; each of said side walls has a locking groove near said front opening; and wherein each of said sliding cable fastening blocks has a front and a rear surfaces, two side portions, and a fastening means for fastening said cable; each of said side portions has a protruding rim disposed within said locking groove; and (b) a stud screw adaptor having a threaded opening having internal threads complimentary to said transformer stud, for connecting said transformer stud and said stud slide adaptor of said cable connector.

2. The transformer connector of claim 1 further comprising a bolt nut adaptable to said transformer stud for securing a connection between said stud slide adaptor and said stud screw adaptor of said cable connector.

3. The transformer connector of claim 1, wherein said fastening means of said sliding cable fastening blocks comprises at least one threaded aperture through said front and rear surfaces, and at least one threaded bolt disposed within said threaded aperture; thereby said cable can be fastened by screwing in said threaded bolt toward said rear wall of said receiving slot.

4. The transformer connector of claim 1, wherein said locking groove has a retainer means for retaining a vertical position of said sliding cable locking block inside said locking groove; and each of said sliding cable locking blocks can be moved out from each of said receiving slots by sliding vertically along said locking grooves through said upper open end.

5. The transformer connector of claim 1, wherein said sliding cable locking block has a retainer means for retaining a vertical position of said sliding cable locking block inside said locking groove.

6. The transformer connector of claim 1, wherein said plurality of receiving slots are aligned one next to another in a row extending along a longitudinal axis of said connection extension.

7. The transformer connector of claim 1, wherein said plurality of receiving slots are aligned one next to another in two rows with said rear walls of a pair of said receiving slots against each other, said rows extending in parallel to a longitudinal axis of said connection extension.

8. The transformer connector of claim 1, wherein said real wall of said receiving slot has a curvature complementary to an external shape of said cable.

9. The transformer connector of claim 1, wherein said stud slide adaptor has a first contact surface around said first opening, in perpendicular to a center axis of said first opening; and said stud screw adaptor has a second contact surface around second opening, in perpendicular to a center axis of said second opening; and said contact surfaces have a complimentary geometry shape and are interlocking.

10. The transformer connector of claim 9, wherein said transformer connector further comprises an adaptor extension; said adaptor extension comprising an extension body having a first end portion and an opposing second end portion, a front side and a rear side; said extension body having a third opening at said first end portion for slidably adapting to said transformer stud and engaging with said stud screw adaptor from said rear side; and an extension connection means at said second end portion for connecting said stud slide adaptor of said cable connector.

11. The transformer connector of claim 10, wherein said extension connection means is a threaded shaft protruding from said front side at said second end portion; said threaded shaft being complementary in size to and for engaging with said first opening of said stud slide adaptor; wherein said stud slide adaptor can be connected to said threaded shaft by a bolt nut.

12. The transformer connector of claim 11, wherein said adaptor extension has a third contact surface around third opening at said rear side, in perpendicular to a center axis of said third opening for interlockingly engaging with said second contact surface of said stud screw adaptor; and a fourth contact surface around said threaded shaft at said front side for interlockingly engaging with said first contact surface of said stud slide adaptor.

13. The transformer connector of claim 10, wherein said extension connection means is a threaded opening at said second end portion, substantially equivalent in size to said first opening of said stud slide adaptor; wherein said stud slide adaptor can be connected to said adaptor extension by placing a threaded bolt through said threaded opening at said second end portion and through said first opening, and fastened by bolt nuts.

14. The transformer connector of claim 13, wherein said adaptor extension has a third contact surface around said third opening at said rear side in perpendicular to a center axis of said third opening for interlockingly engaging with said second contact surface of said stud screw adaptor; a fourth contact surface around said threaded opening at said second end portion at said front side for interlockingly engaging with said first contact surface of said stud slide adaptor.

15. A transformer adaptor comprising:

(a) an inter-connector comprising a connecting shaft having external screw threads at a first end for connecting to a cable connector; and a stud slide adaptor connected to a side of said connecting shaft adjacent to an opposing second end thereof, said stud slide adaptor having a first unthreaded opening;

(b) a stud screw adaptor having a first threaded opening complimentary to said transformer stud for connecting to said transformer stud; and (c) an adaptor extension; said adaptor extension comprising an extension body having a first end portion and an opposing second end portion, a front side and a rear side; said extension body having a second unthreaded opening at said first end portion for adapting to said transformer stud and engaging with said stud screw adaptor from said rear side; and an extension connection means at said second end portion for connecting said stud slide adaptor of said inter-connector.

16. The transformer adaptor of claim 15, wherein said stud slide adaptor has a first contact surface around said first unthreaded opening, in perpendicular to a center axis of said first unthreaded opening; and said stud screw adaptor has a second contact surface around said first threaded opening, in perpendicular to a center axis of said first threaded opening; and said contact surfaces have a complimentary geometry shape and are interlocking.

17. The transformer adaptor of claim 16, wherein said extension connection means is a threaded shaft protruding from said front side at said second end portion; said threaded shaft being complementary in size to and for engaging with said first unthreaded opening of said inter-connector; wherein said inter-connector can be connected to said threaded shaft by a bolt nut.

18. The transformer adaptor of claim 17, wherein said adaptor extension has a third contact surface around said second unthreaded opening at said rear side, in perpendicular to a center axis of said second unthreaded opening for interlockingly engaging with said second contact surface of said stud screw adaptor; and a fourth contact surface around said threaded shaft at said front side for interlockingly engaging with said first contact surface of said stud slide adaptor.

19. The transformer adaptor of claim 16, wherein said extension connection means is a threaded opening at said second end portion, substantially equivalent in size to said first unthreaded opening of said stud slide adaptor; wherein said stud slide adaptor can be connected to said adaptor extension by placing a threaded bolt through said threaded opening at said second end portion and through said first unthreaded opening, and fastened by bolt nuts.

20. The transformer adaptor of claim 19, wherein said adaptor extension has a third contact surface around said second unthreaded opening at said rear side in perpendicular to a center axis of said second unthreaded opening for interlockingly engaging with said second contact surface of said stud screw adaptor; a fourth contact surface around said threaded opening at said second end portion at said front side for interlockingly engaging with said first contact surface of said stud slide adaptor.

21. A transformer connector comprising:

(a) a cable connector comprising a cable attachment body having a plurality of cable attachment ports; a connector extension having a first end and an opposing second end, said first end being connected to said cable attachment section; and a stud slide adaptor connected to a side of said connector extension adjacent to said second end, said stud slide adaptor having a first unthreaded opening;

(b) a stud screw adaptor having a first threaded opening complimentary to said transformer stud for connecting to said transformer stud; and (c) an adaptor extension; said adaptor extension comprising an extension body having a first end portion and an opposing second end portion, a front side and a rear side; said extension body having a second unthreaded opening at said first end portion for adapting to said transformer stud and engaging with said stud screw adaptor from said rear side; and an extension connection means at said second end portion for connecting said stud slide adaptor of said cable connector.

22. The transformer adaptor of claim 21, wherein said stud slide adaptor has a first contact surface around said first unthreaded opening, in perpendicular to a center axis of said first unthreaded opening; and said stud screw adaptor has a second contact surface around said first threaded opening, in perpendicular to a center axis of said first threaded opening; and said contact surfaces have a complimentary geometry shape and are interlocking.

23. The transformer adaptor of claim 22, wherein said extension connection means is a threaded shaft protruding from said front side at said second end portion; said threaded shaft being complementary in size to and for engaging with said first unthreaded opening of said cable connector; wherein said cable connector can be connected to said threaded shaft by a bolt nut.

24. The transformer adaptor of claim 23, wherein said adaptor extension has a third contact surface around said second unthreaded opening at said rear side, in perpendicular to a center axis of said second unthreaded opening for interlockingly engaging with said second contact surface of said stud screw adaptor; and a fourth contact surface around said threaded shaft at said front side for interlockingly engaging with said first contact surface of said stud slide adaptor.

25. The transformer adaptor of claim 22, wherein said extension connection means is a threaded opening at said second end portion, substantially equivalent in size to said first unthreaded opening of said stud slide adaptor; wherein said stud slide adaptor can be connected to said adaptor extension by placing a threaded bolt through said threaded opening at said second end portion and through said first unthreaded opening, and fastened by bolt nuts.

26. The transformer adaptor of claim 25, wherein said adaptor extension has a third contact surface around said second unthreaded opening at said rear side in perpendicular to a center axis of said second unthreaded opening for interlockingly engaging with said second contact surface of said stud screw adaptor; a fourth contact surface around said threaded opening at said second end portion at said front side for interlockingly engaging with said first contact surface of said stud slide adaptor.

* * * * *